US008526842B2

(12) United States Patent
Ichihashi et al.

(10) Patent No.: US 8,526,842 B2
(45) Date of Patent: Sep. 3, 2013

(54) IMAGE FORMING APPARATUS

(75) Inventors: Osamu Ichihashi, Kanagawa (JP); Ryuuichi Mimbu, Kanagawa (JP); Kenji Sengoku, Kanagawa (JP); Junpei Fujita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 315 days.

(21) Appl. No.: 13/093,217

(22) Filed: Apr. 25, 2011

(65) Prior Publication Data

US 2011/0286759 A1 Nov. 24, 2011

(30) Foreign Application Priority Data

May 19, 2010 (JP) ..... 2010-115605

(51) Int. Cl.
*G03G 15/00* (2006.01)

(52) U.S. Cl.
USPC ..... 399/90

(58) Field of Classification Search
USPC ..... 399/90
See application file for complete search history.

(56) References Cited

U.S. PATENT DOCUMENTS

| | | | | |
|---|---|---|---|---|
| 5,130,751 | A * | 7/1992 | Sato et al. | 399/96 |
| 6,144,819 | A * | 11/2000 | Nishiuwatoko | 399/90 |
| 6,901,234 | B2 | 5/2005 | Ogiyama et al. | |
| 6,947,693 | B2 | 9/2005 | Kamiya et al. | |
| 7,502,583 | B2 | 3/2009 | Sawai et al. | |
| 7,532,370 | B2 | 5/2009 | Kudo et al. | |
| 7,742,721 | B2 | 6/2010 | Mimbu | |
| 7,773,928 | B2 | 8/2010 | Ogiyama et al. | |
| 2005/0030741 | A1* | 2/2005 | Uke | 362/200 |
| 2006/0210299 | A1* | 9/2006 | Portig et al. | 399/90 |
| 2008/0232867 | A1 | 9/2008 | Minbu et al. | |
| 2009/0060611 | A1 | 3/2009 | Minbu | |
| 2009/0142083 | A1 | 6/2009 | Minbu | |
| 2009/0279927 | A1 | 11/2009 | Fujita | |
| 2010/0061741 | A1 | 3/2010 | Minbu | |
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2010/0272478 | A1 | 10/2010 | Ichihashi | |
| 2011/0064487 | A1 | 3/2011 | Ichihashi et al. | |

FOREIGN PATENT DOCUMENTS

| | | |
|---|---|---|
| JP | 2000-75655 | 3/2000 |
| JP | 2008-129448 | 6/2008 |

* cited by examiner

*Primary Examiner* — G. M. Hyder
(74) *Attorney, Agent, or Firm* — Oblon, Spivak, McClelland, Maier & Neustadt, L.L.P.

(57) ABSTRACT

An image forming apparatus includes a contact member supplied with voltage by a voltage application device, to contact an object; a rotary member rotatable about a rotation fulcrum shaft fixed to an image forming apparatus, to support the contact member; an biasing member to urge the rotary member to press the contact member against the object; a rotary conductive member fixed to the rotary member and connected electrically to the contact member; a main body side conductive member fixed to the rotation fulcrum shaft at the main body side and connected electrically to the voltage application device; and a conductive connector provided along the rotation fulcrum shaft to contact the rotary conductive member in an axial direction to connect electrically the main body side conductive member and the rotary conductive member. A contact of the conductive connector and a contact of the rotary conductive member are unfixed.

10 Claims, 6 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2010-115605, filed on May 19, 2010 in the Japan Patent Office, which is hereby incorporated herein by reference in its entirety.

BACKGROUND OF THE INVENTION

1. Field of the Invention

Exemplary aspects of the present invention generally relate to an image forming apparatus, such as a copier, a facsimile machine, a printer, or a digital multi-functional system including a combination thereof, and more particularly, to a transfer device that contacts an image bearing member and an image forming apparatus including the transfer device.

2. Description of the Background Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image bearing member; an optical writer projects a light beam onto the charged surface of the image bearing member to form an electrostatic latent image on the image bearing member according to the image data; a developing device supplies toner to the electrostatic latent image formed on the image bearing member to make the electrostatic latent image visible as a toner image; the toner image is directly transferred from the image bearing member onto a recording medium or is indirectly transferred from the image bearing member onto a recording medium via an intermediate transfer member; a cleaning device then cleans the surface of the image carrier after the toner image is transferred from the image carrier onto the recording medium; finally, a fixing device applies heat and pressure to the recording medium bearing the unfixed toner image to fix the unfixed toner image on the recording medium, thus forming the image on the recording medium.

There are two types of known color-electrophotography image forming apparatuses. One is a single-drum color image forming apparatus that includes one photoconductive drum around which a plurality of developing devices designated for different colors of toner is disposed. A composite toner image is formed on the photoconductive drum with toner by the developing devices.

The other type of known color-electrophotographic image forming apparatus is a so-called tandem-type image forming apparatus, in which a plurality of photoconductive drums, one for each of the colors black, cyan, magenta, and yellow, is arranged in tandem and each provided with a developing device. Multiple toner images of a respective single color are formed on the photoconductive drums. Then, the toner images are transferred onto an intermediate transfer member or a recording medium so that they are superimposed one atop the other, thereby forming a composite color toner image.

Alternatively, in the tandem-type image forming apparatus, the toner images formed on the plurality of the photoconductive drums may be temporarily transferred onto the intermediate transfer belt by a plurality of primary transfer rollers, and then ultimately onto the recording medium by a secondary transfer roller.

In such a tandem-type color-electrophotography image forming apparatus, an intermediate transfer device including the primary transfer rollers usually has a long horizontal axis because the plurality of the photoconductive drums are arranged linearly. Moreover, to enhance speed and durability of the image forming apparatus, a diameter of the photoconductive drum is increased. Consequently, the total length of the intermediate transfer device increases.

In view of the above, in order to maintain strength of the intermediate transfer device, a housing and parts that support each device in the intermediate transfer device are made of steel plates.

In one example of such an intermediate transfer device, the plurality of primary transfer rollers that contacts the respective photoconductive drums is supported by a single swingable arm serving as a roller support member and pressed against the photoconductive drums by compression springs. Rotation of the swingable arm about a shaft enables the primary transfer rollers to contact or separate from the photoconductive drums.

Although advantageous and generally effective for its intended purpose, there is a drawback to this configuration in that the distance from a point of support of the swingable arm to a point of load tends to be long, thereby degrading the strength of the swingable aim.

In this configuration, rotation of the roller support member enables the primary transfer roller to contact the photoconductive drum. In order to achieve stable contact between the primary transfer roller and the photoconductive drum, it is important to prevent the electric connection from the power source to the primary transfer roller from interfering with rotation of the roller support member.

Furthermore, since a high voltage in a range of 1 [kV] to 10 [kV] is generally applied to the primary transfer roller to transfer the toner images on the photoconductive drum, shielding ability is also desired to prevent leak current.

At the same time, however, since the primary transfer roller rotates together with the swingable arm, that is, the roller support member, reliable electric connection needs to be maintained even when the position of the electrical contact at the primary transfer roller side moving together with the roller support member changes relative to the electrical contact at the power source side fixed to the main body.

In view of the above, a wire harness is used to connect loosely the contact subjected to move and the contact fixed to the main body, in which the wire harness is not stretched but retains slack. Alternatively, a coil spring is used to connect the contact subjected to move and the contact fixed to the main body.

In a related-art image forming apparatus, the coil spring is used to electrically connect a roller support shaft that rotates together with a rotary member and a voltage application device fixed to the main body. In this configuration, the coil spring serves as the voltage application path between the roller support shaft and the voltage application device. According to this configuration, even when the rotary member rotates, moving the contact at the roller support shaft side, elasticity of the coil spring allows the coil spring to deform in accordance with the displacement of the contact at the roller support shaft side relative to the contact at the voltage application device side, thereby maintaining electric connection between the roller support shaft and the voltage application device.

Although advantageous, when using connecting parts such as the wire harness and the coil spring to connect the contact subjected to move and the contact fixed to the main body, the weight of connecting parts and resilience act in the direction causing the roller support member to rotate, hence changing the contact pressure of the primary transfer roller. For example, in the case of the wire harness, the weight of the slack wire harness acts on the contact of the roller support shaft, moving the contact down and hence changing the contact pressure. In the case of the coil spring, the coil spring twists undesirably, moving the contact of the roller support shaft as well.

Furthermore, since the majority of parts constituting the intermediate transfer device are made of metal plates, the size and the number of parts needed to prevent leak current at the point of support of the spring increase, thereby complicating efforts to reduce cost and facilitate assembly.

SUMMARY OF THE INVENTION

In view of the foregoing, in one illustrative embodiment of the present invention, an image forming apparatus includes a contact member, a rotary member, a biasing member, a rotary conductive member, a voltage application device, a main body side conductive member, and a conductive connector. The contact member is supplied with a voltage and contacts an object. The rotary member is rotatable about a rotation fulcrum shaft fixed to the image forming apparatus, and supports the contact member. The biasing member urges the rotary member to press the contact member against the object. The rotary conductive member is fixed to the rotary member and connected electrically to the contact member. The voltage application device is fixed to the image forming apparatus and applies voltage to the contact member through the rotary conductive member. The main body side conductive member is fixed to the rotation fulcrum shaft at the main body side and connected electrically to the voltage application device. The conductive connector is provided along the rotation fulcrum shaft to contact the rotary conductive member in the axial direction of the rotation fulcrum shaft, to connect electrically the main body side conductive member and the rotary conductive member. The contact of the conductive connector and a contact of the rotary conductive member are unfixed.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
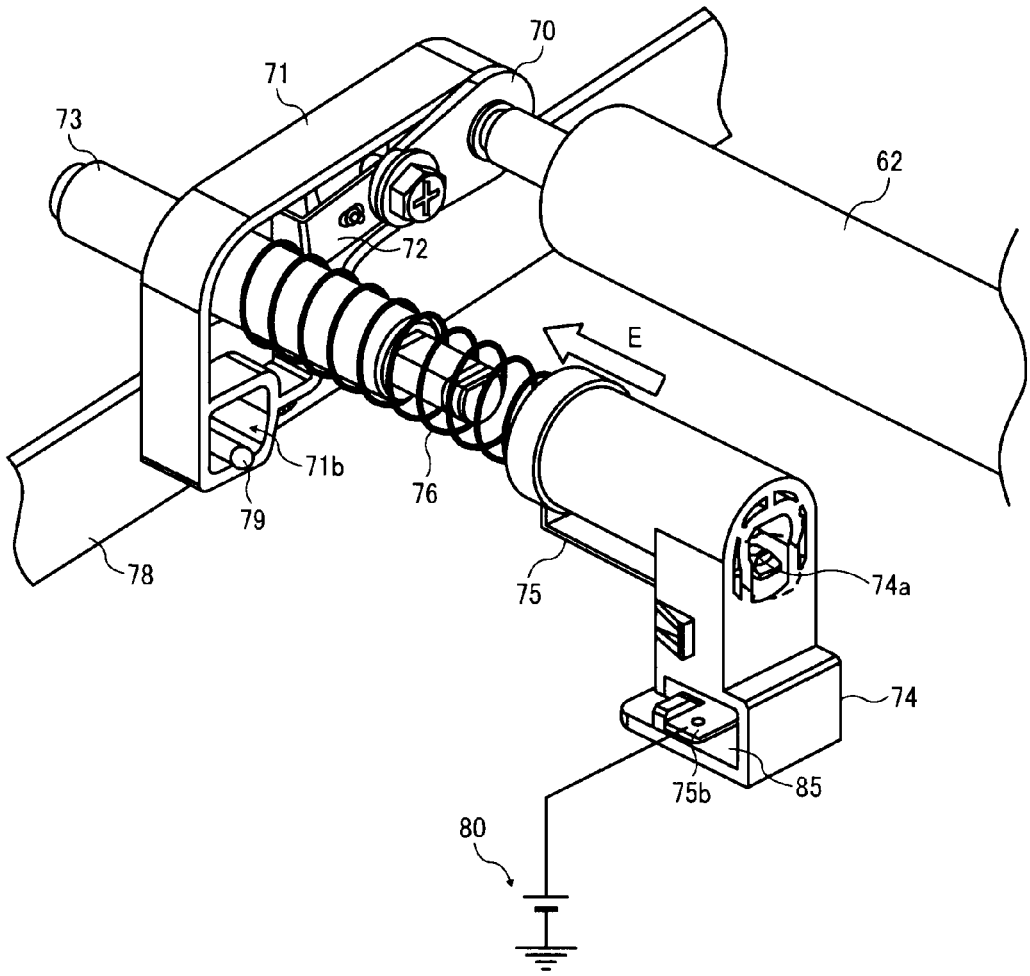
FIG. 1 is a schematic perspective view of a schematic perspective view of a voltage application mechanism to apply voltage to a primary transfer roller before a bias application bracket is fixed to a rotation fulcrum shaft according to an illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Figure 2:
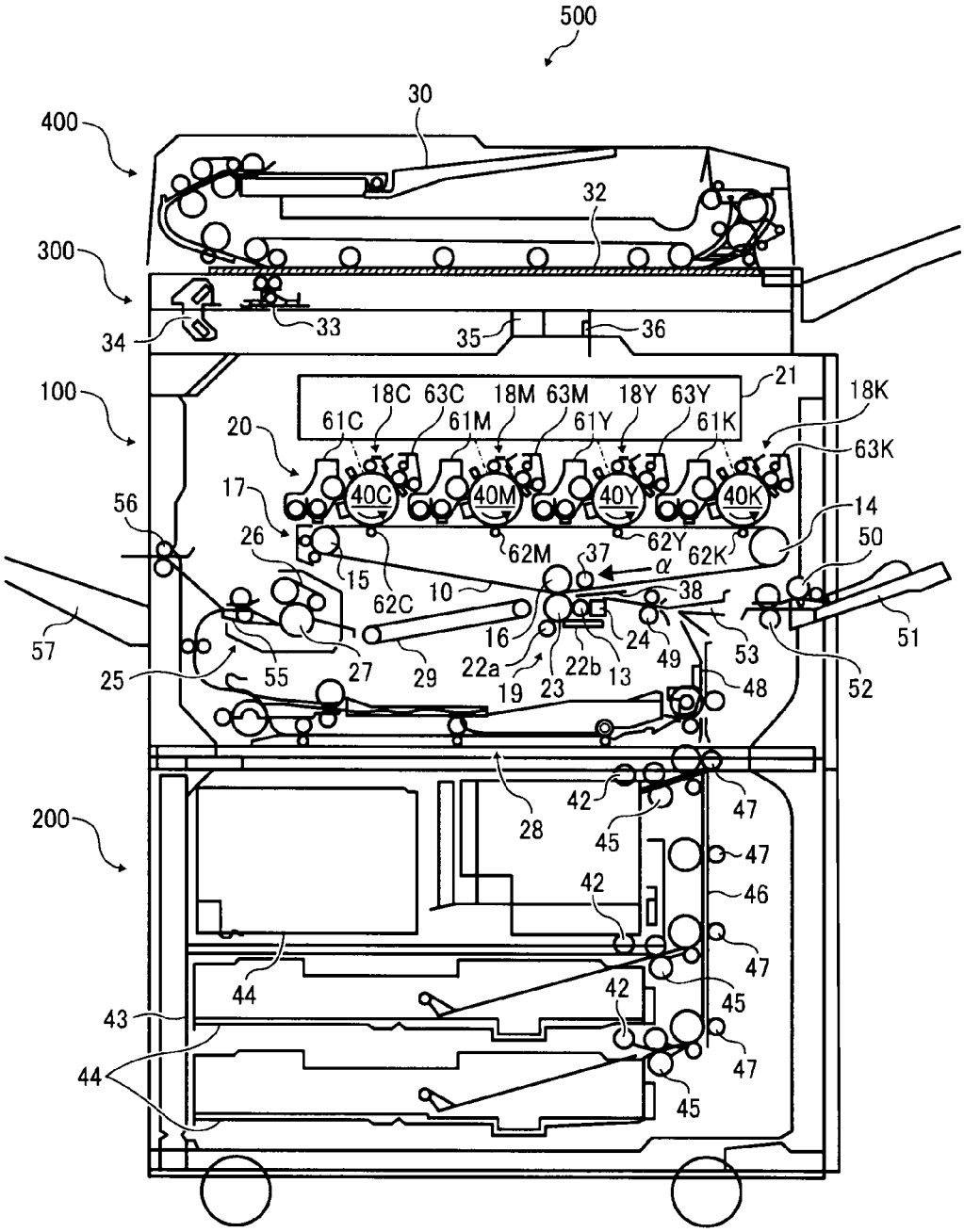
FIG. 2 is a schematic diagram illustrating a copier as an example of an image forming according to the illustrative embodiment of the present invention.

Referring now to the drawings, wherein like reference numerals designate identical or corresponding parts throughout the several views, in particular to FIG. 2, an image forming apparatus according to an exemplary embodiment of the present invention is explained. FIG. 2 is a schematic diagram illustrating a copier as an example of an image foaming according to the illustrative embodiment of the present invention.

As illustrated in FIG. 2, an image forming apparatus 500 includes a printer unit 100, a sheet feeding unit 200, a scanner 300, and an automatic document feeder (ADF).

Although not illustrated, the scanner 300 includes a first carriage 33 and a second carriage 34. The first carriage 33 includes a mirror, a light source for illuminating an original document placed on a contact glass 32, and so forth. The second carriage 34 includes a plurality of reflective mirrors. The first carriage 33 and the second carriage 34 move back and forth to scan the original document placed on the contact glass 32 disposed substantially at an upper portion of the image forming apparatus 500.

An imaging lens 35 focuses scan light projected from the second carriage 34 on an imaging surface of a read sensor 36 disposed behind the imaging lens 35. Subsequently, the scan light is read as an image signal by the read sensor 36.

The printer unit 100 includes four photoconductive drums 40Y, 40C, 40M, and 40K serving as latent image bearing members, one for each of the toners of yellow, cyan, magenta, and black, respectively.

Devices used for electrophotographic processing, such as a charging device, a developing device, a cleaning device, and so forth are disposed around each of the photoconductive drums 40, thereby constituting image forming stations 18Y, 18M, 18C, and 18K. The image forming stations 18Y, 18M, 18C, and 18K are arranged in tandem, thereby constituting a tandem-type image forming unit 20.

The image forming stations 18Y, 18M, 18C, and 18K include developing devices 61Y, 61M, 61C, and 61K, respectively. The developing devices 61Y, 61M, 61C, and 61K employ a developing agent including toner of the respective color.

It is to be noted that reference characters Y, C, M, and K denote colors yellow, cyan, magenta, and black, respectively. To simplify the description, the reference characters Y, M, C, and K indicating colors are omitted herein, unless otherwise specified.

In the developing device 61, a developing agent bearing member conveys the developing agent to the position at which the developing agent bearing member and the photoconductive drum 40 face each other, and an alternating electric field is applied thereto. Accordingly, an electrostatic latent image on the photoconductive drum 40 is developed. The developing agent is activated by applying the alternating electric field. The distribution of an amount of charge of the toner is narrowed, thereby enhancing developing ability.

The developing device 61 and the photoconductive drum 40 may be supported together as a single integrated unit, thereby constituting a process cartridge detachably mountable relative to the image forming apparatus 500. Such a process cartridge may include the charging device and the cleaning device.

Substantially above the image forming unit 20, an exposure device 21 is disposed. The exposure device 21 illuminates the photoconductive drum 40 with laser light or LED light based on image information.

An endless, looped intermediate transfer belt 10 is disposed substantially below the image forming unit 20, opposite the photoconductive drums 40. The intermediate transfer belt 10 is supported by a plurality of support rollers 14, 15, and 16.

Primary transfer rollers 62 are disposed inside the loop formed by the intermediate transfer belt 10, each facing the respective photoconductive drum 40 via the intermediate transfer belt 10. The primary transfer rollers 62 form a primary transfer electric field between the primary transfer rollers 62 and the photoconductive drums 40 so that the toner images formed on the photoconductive drums 40 are transferred onto the intermediate transfer belt 10 and they are superimposed on atop the other, thereby forming a composite toner image.

A cleaning device 17 is disposed near the intermediate transfer belt 10 to remove residual toner remaining on the intermediate transfer belt 10 after the transfer process. The cleaning device 17 includes a fur brush or a cleaning blade made of, for example, and urethane rubber to contact the intermediate transfer belt 10 to remove residual toner remaining on the intermediate transfer belt 10 after a secondary transfer process.

Substantially below the intermediate transfer belt 10, a secondary transfer device 19 is disposed. The secondary transfer device 19 transfers the composite toner image formed on the intermediate transfer belt 10 onto a recording medium, such as a transfer sheet, conveyed from a sheet cassette 44 of the sheet feeding unit 200.

The secondary transfer device 19 includes a secondary transfer roller 23 and a contact/separation mechanism, not illustrated, that supports the secondary transfer roller 23 to contact or separate from the intermediate transfer belt 10. The contact/separation mechanism includes a secondary transfer roller support rotatable about a shaft fixed to the secondary transfer device 19. Rotation of the secondary transfer roller support enables the secondary transfer roller 23 to contact or separate from the secondary transfer support roller 16 facing the secondary transfer roller 23 through the intermediate transfer belt 10.

In the secondary transfer device 19, the secondary transfer roller 23 is pressed against the secondary transfer support roller 16 through the intermediate transfer belt 10, thereby defining a secondary transfer nip therebetween in which the toner image on the intermediate transfer belt 10 is transferred onto the recording medium.

Further, in the secondary transfer device 19, an electric field roller 22*a* and a cleaning blade 22*b* contact the secondary transfer roller 23. The electric field roller 22*a* electrostatically transfers toner adhered to the secondary transfer roller 23. The cleaning blade 22*b* mechanically removes the toner adhered to the secondary transfer roller 23.

The secondary transfer device 19 includes an application brush roller 13 that scrapes a solid lubricant 24 and applies the lubricant on the secondary transfer roller 23. Application of the lubricant on the secondary transfer roller 23 facilitates separation of the toner from the secondary transfer roller 23.

A guide plate 38 is disposed upstream from the secondary transfer nip in the direction of travel of the intermediate transfer belt 10, indicated by an arrow a in FIG. 2. The guide plate 38 guides the recording medium to the secondary transfer nip such that the toner image on the intermediate transfer belt 10 and the recording medium do not contact each other upstream from the secondary transfer nip in the direction of travel of the intermediate transfer belt 10 for a long time.

On the left of the secondary transfer device 19 in FIG. 2, a sheet conveyance belt 29 formed into a loop is disposed. On the left of the sheet conveyance belt 29, a fixing device 25 is disposed. The fixing device 25 fixes the toner image on the recording medium. The fixing device 25 includes a fixing belt 26 formed into a loop and a pressing roller 27 pressing against the fixing belt 26.

Substantially below the secondary transfer device 19 and the fixing device 25, a reverse unit 28 that reverses the recording medium is disposed. The reverse unit 28 reverses the recording medium passed through the fixing device 25 and sends the recording medium to the secondary transfer nip to record an image on both sides of the recording medium.

Next, a description is provided of an image forming operation of the image forming apparatus 500. First, an original document is placed on a document table 30 of the automatic document feeder (hereinafter ADF) 400 or on the contact glass 32 of the scanner 300 by opening the ADF 400. When the document is placed on the contact glass 32, the ADF 400 is closed.

When pressing a start button, not illustrated, of the image forming apparatus, the document in the ADF 400 is conveyed to the contact glass 32. In the case of directly placing the document on the contact glass 32, the scanner 300 is driven immediately, enabling the first carriage 33 and the second carriage 34 to scan the document.

The light source of the first carriage 33 projects light against the document which is then reflected on the document. The reflected light is reflected towards the second carriage 34. The mirror of the second carriage 34 reflects the reflected light towards the focusing lens 35 which directs the light to the read sensor 36. The read sensor 36 reads the document.

When the start button is pressed, the drive motor, not illustrated, is driven, enabling one of the support rollers 14, 15, and 16 to rotate, and other two rollers to follow. Accordingly, the intermediate transfer belt 10 is moved in the direction indicated by the arrow a in FIG. 2.

In the meantime, in each of the image forming stations 18, the charging device charges uniformly the surface of the photoconductive drum 40, and the exposure device 21 illuminates the photoconductive drum 40 with write light L such as the laser light and the LED, in accordance with information read by the scanner 300. As a result, an electrostatic latent image is formed on the surface of the charged photoconductive drum 40.

Subsequently, the developing device 61 supplies toner to the surface of the photoconductive drum 40 on which the electrostatic latent image is formed, thereby forming a visible image, also known as a toner image. The toner images of black, yellow, magenta, and cyan are formed on the respective photoconductive drums 40.

The primary transfer electric field formed between the photoconductive drums 40 and the primary transfer rollers 62 facing the photoconductive drums 40 transfers the toner images formed on the photoconductive drums 40 onto the intermediate transfer belt 10 so that they are superimposed one atop the other, thereby forming a composite color toner image on the intermediate transfer belt 10.

The residual toner remaining on the photoconductive drum 40 after the toner image is transferred is cleaned by a cleaning device 63. A charge eraser, not illustrated, removes electricity from the photoconductive drum 40 in preparation for the subsequent imaging cycle.

When the start button is pressed, one of sheet feed rollers 42 of the sheet feeding unit 200 is selected to rotate, thereby feeding the recording medium from the sheet cassette 44. The recording medium supplied from the sheet feed cassette 44 is fed to a sheet conveyance path 46 one sheet at a time by a separation roller 45. Conveyance rollers 47 guide the recording medium to a pair of registration rollers 49 along a printer sheet path 48, and the recording medium stops at the registration rollers 49.

In a case in which the recording medium is fed manually, a manual feed roller 50 is rotated to feed the recording medium placed on a manual feed tray 51. A separation roller pair 52 separates the recording medium one by one to feed the recording medium to a manual feed path 53.

Similar to feeding the recording medium from the sheet cassette 44, the recording medium is conveyed to the pair of registration rollers 49 which stops the recording medium temporarily.

Subsequently, rotation of the pair of registration rollers 49 resumes, and the recording medium is sent to the secondary transfer nip in appropriate timing such that the recording medium is aligned with the composite color toner image formed on the intermediate transfer belt 10. Then, the composite color toner image on the intermediate transfer belt 10 is transferred onto the recording medium in the secondary transfer device 19.

After the recording medium bearing the unfixed toner image passes through the secondary transfer nip, the recording medium is conveyed to the sheet conveyance belt 29 which conveys the recording medium to the fixing device 25.

In the fixing device 25, the toner image on the recording medium is fixed with heat and pressure, thereby yielding an output image.

The direction of conveyance of the recording medium after the image is fixed is switched by a switching claw 55. For example, the recording medium on which the image is fixed is discharged onto a sheet discharge tray 57 by sheet discharge rollers 56.

Alternatively, the direction of conveyance of the recording medium may be switched to the reverse unit 28 by the switching claw 55. In this case, the recording medium is reversed in the reverse unit 28 and guided to the secondary transfer nip again, thereby forming an image on the other side of the recording medium. Subsequently, the recording medium is discharged onto the sheet discharge tray 57 by the sheet discharge rollers 56.

The residual toner remaining on the intermediate transfer belt 10 after the image is transferred at the secondary transfer nip is removed by the cleaning device 17 in preparation for the subsequent image forming operation in the tandem image forming unit 20.

Figure 3:
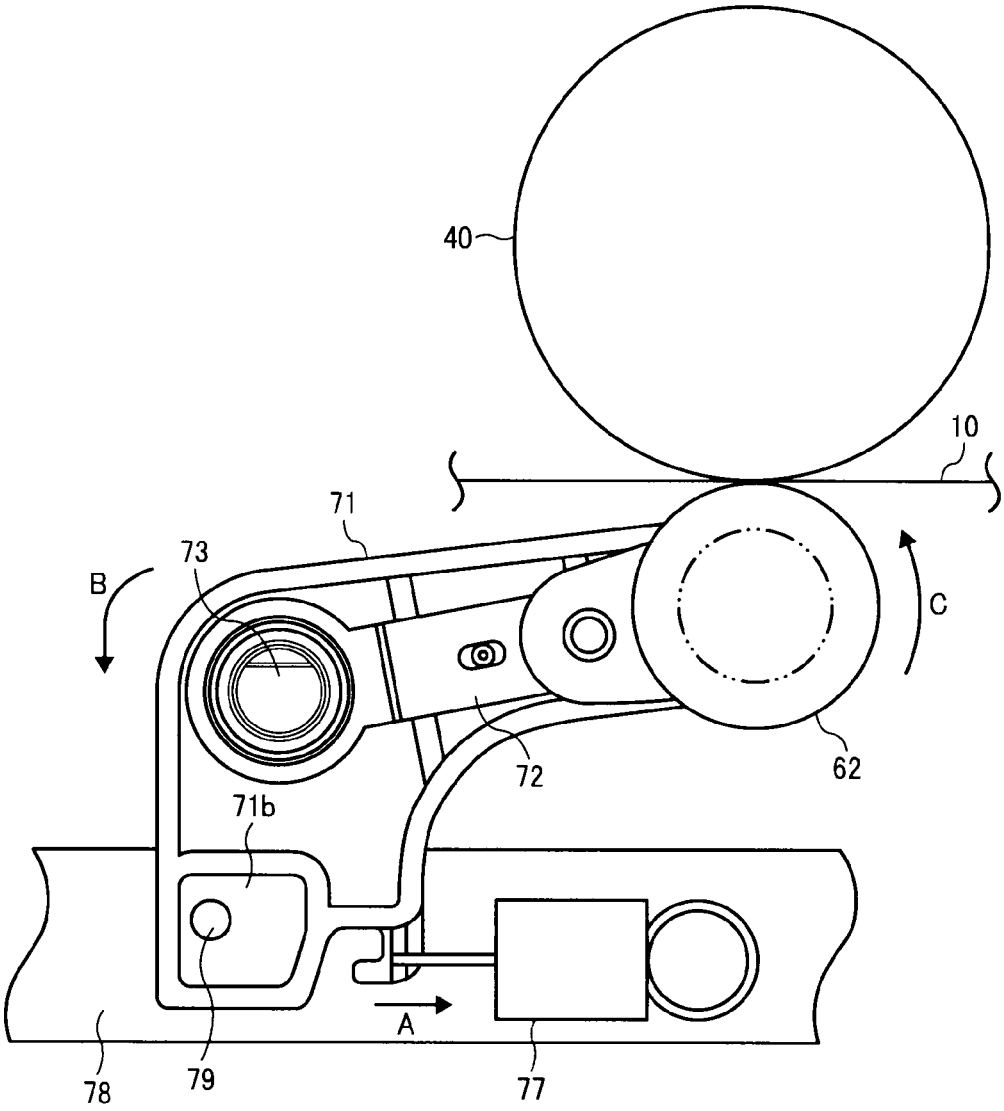
FIG. 3 is a partially enlarged diagram illustrating one of the primary transfer areas when the primary transfer roller of FIG. 1 contacts a photoconductive drum through an intermediate transfer belt according to the illustrative embodiment of the present invention.

With reference to FIGS. 1 and 3, a description is provided of how the primary transfer roller 62 contacts the photoconductive drum 40 according to the illustrative embodiment. FIG. 1 is a schematic perspective view of a voltage application mechanism before a bias application bracket 74 is fixed to a rotation fulcrum shaft 73, to apply voltage to the primary transfer roller 62. FIG. 3 is an enlarged schematic diagram illustrating one primary transfer area including the primary transfer rollers 62 and the photoconductive drums 40.

As illustrated in FIG. 3, the primary transfer roller 62 contacts the photoconductive drum 40 through the intermediate transfer belt 10 at the primary transfer area.

According to the illustrative embodiment, the primary transfer area of the image forming apparatus 500 includes the primary transfer roller 62, a roller support bracket 71, a tension spring 77, a rotary bias terminal 72, and a power source 80.

The primary transfer roller 62 serves as a contact member supplied with a voltage to contact the photoconductive drum 40 through the intermediate transfer belt 10. The roller support bracket 71 is rotatable about the rotation fulcrum shaft 73 fixed to the main body and supports the primary transfer roller 62.

The tension spring 77 is a biasing member that urges the roller support bracket 71 such that the primary transfer roller 62 rotatably moves in the direction pressing against the photoconductive drum 40. That is, as the force of the tension spring 77 acts in the direction indicated by arrow A in FIG. 3, the roller support bracket 71 rotates about the rotation fulcrum shaft 73 in the direction indicated by an arrow B, enabling the primary transfer roller 62 to move in the direction indicated by arrow C to contact the photoconductive drum 40.

As illustrated in FIG. 1, the primary transfer roller 62 is rotatably supported by the roller support bracket 71 via a conductive shaft bearing 70.

The rotary bias terminal 72 is a rotary conductive member fixed to the roller support bracket 71 and connected electrically to the conductive shaft bearing 70.

The power source 80 is a voltage application device fixed to the main body of the image forming apparatus, to apply a voltage to the primary transfer roller 62 through the rotary bias terminal 72.

In this configuration, therefore, a voltage application path is formed from the rotary bias terminal 72 to the primary transfer roller 62.

The roller support bracket 71 is rotatably supported about the rotation fulcrum shaft 73. Rotation of the roller support bracket 71 enables the primary transfer roller 62 to contact or separate from the photoconductive drum 40.

Figure 4:
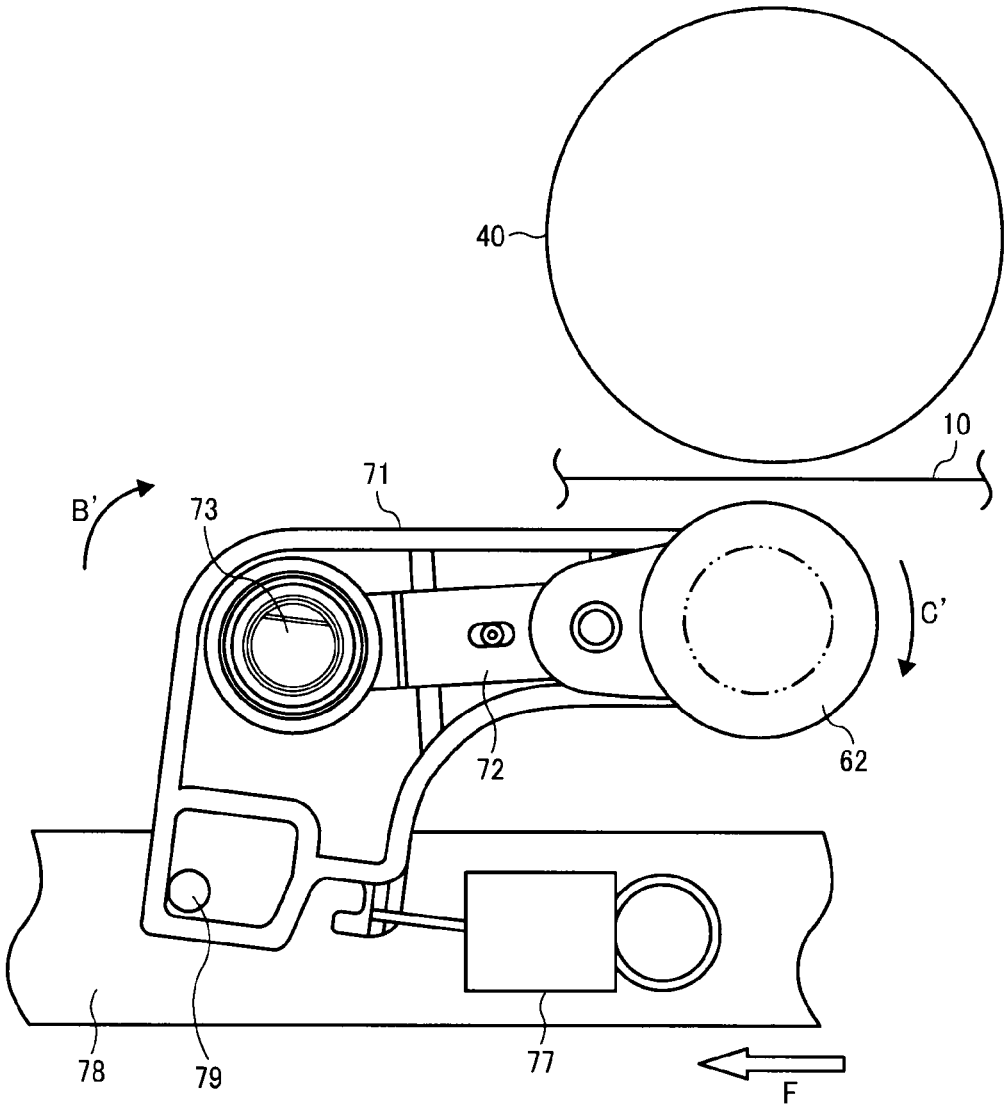
FIG. 4 is a partially enlarged diagram illustrating one of the primary transfer areas when the primary transfer roller is separated from the photoconductive drum according to the illustrative embodiment of the present invention.

With reference to FIG. 4, a description is provided of the primary transfer roller 62 separated from the photoconductive drum 40 at the primary transfer area shown in FIG. 3. FIG. 4 is a partially enlarged schematic diagram illustrating the primary transfer area when the primary transfer roller 62 is separated from the photoconductive drum 40 according to the illustrative embodiment.

As illustrated in FIGS. 1 and 3, the image forming apparatus 500 includes a slide member 78 including a pin 79, positioned in an opening 71*b* of the roller support bracket 71 of the primary transfer area.

During the image forming operation, as illustrated in FIG. 3, the slide member 78 is positioned such that the pin 79 does not contact the opening 71*b* of the roller support bracket 71.

In this state, the primary transfer roller 62 contacts the photoconductive drum 40 due to the spring force of the tension spring 77. By contrast, when the image forming operation is not performed, as illustrated in FIG. 4, the slide member 78 is moved to the left, that is, in the direction indicated by arrow F in FIG. 4, due to a drive force of a drive mechanism, not illustrated, thereby causing the pin 79 to contact a side of the opening 71*b* of the roller support bracket 71.

Accordingly, a rotary force in the direction indicated by arrow B' acts on the roller support bracket 71, thereby rotating the roller support bracket 71 about the rotation fulcrum shaft 73 and moving the primary transfer roller 62 away from the photoconductive drum 40 in the direction indicated by an arrow C'.

Figure 5A:
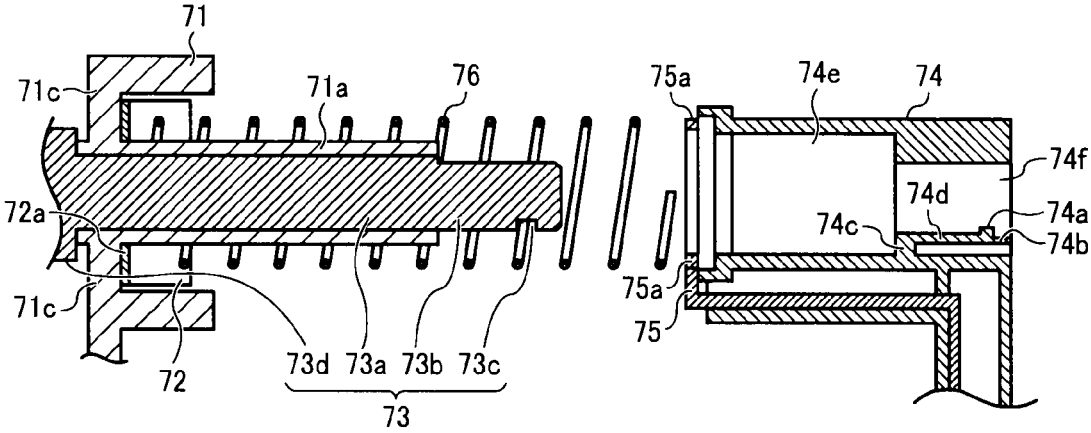
FIG. 5A is a cross-sectional view of the primary transfer area before the bias application bracket is fixed to the rotation fulcrum shaft according to the illustrative embodiment of the present invention.
Figure 5B:
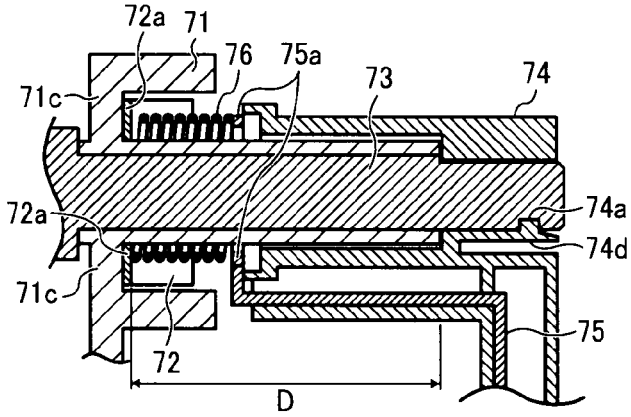
FIG. 5B is a cross-sectional view of the primary transfer area when the bias application bracket is fixed to the rotation fulcrum shaft according to the illustrative embodiment of the present invention.

With reference to FIGS. 5A and 5B, a description is provided of positioning of the bias application bracket 74 relative to the rotation fulcrum shaft 73. FIG. 5A is a cross-sectional view of the primary transfer area along the rotation fulcrum shaft 73 of FIG. 1, before the bias application bracket 74 is fixed to the rotation fulcrum shaft 73. FIG. 5B is a cross-sectional view of the primary transfer area when the bias application bracket 74 is fixed to the rotation fulcrum shaft 73.

The bias application bracket 74 serves as a conductive member support to support a bias terminal 75 for main body side and is affixed to the rotation fulcrum shaft 73 in the axial direction of the rotation fulcrum shaft 73 by a claw-shaped projection 74*a* provided to the bias application bracket 74. The position of the roller support bracket 71 in the axial direction relative to the rotation fulcrum shaft 73 is fixed by contacting the bias application bracket 74.

The bias terminal 75 serving as a conductive member for the main body side, connected electrically to the power source 80, is fixed to the bias application bracket 74. The bias application bracket 74 is fixed to the rotation fulcrum shaft 73 as described above so that the position of the bias terminal 75 is fixed relative to the rotation fulcrum shaft 73.

As illustrated in FIG. 1, an opening 85 for connection of a connector is provided substantially at the bottom of the bias application bracket 74. A bias input portion 75*b*, which is a part of the bias terminal 75, is exposed from the opening 85. The power source 80 and the bias terminal 75 are electrically connected by a wire harness, not illustrated. By inserting a connector of the wire harness connected to the power source 80 into the opening 85, a voltage application path is formed from the power source 80 to the bias terminal 75.

As illustrated in FIG. 5B, the compression spring 76 serving as a conductive connector is disposed between the rotary bias terminal 72 and the bias terminal 75. One end of the compression spring 76 in the axial direction contacts a rotary terminal input contact 72*a* which is a part of the rotary bias terminal 72, and the other end of the compression spring 76 contacts a terminal output contact 75*a* which is a part of the bias terminal 75. Accordingly, the rotary bias terminal 72 and the bias terminal 75 are electrically connected, forming a voltage application path from the bias terminal 75 to the rotary bias terminal 72.

In the image forming apparatus 500, the voltage application path from the power source 80 to the bias terminal 75, the voltage application path from the bias terminal 75 to the rotary bias terminal 72, and the voltage application path from the rotary bias terminal 72 to the primary transfer roller 62 together constitute a voltage application path from the power source 80 to the primary transfer roller 62.

The compression spring 76 is disposed along the rotation fulcrum shaft 73 and contacts the rotary bias terminal 72 and the bias terminal 75 in the axial direction of the rotation fulcrum shaft 73 (orthogonal to the plane of FIG. 3) at different positions, thereby transmitting a contact force in the axial direction. The compression spring 76 is connected electrically to the rotary bias terminal 72 by contacting the rotary bias terminal 72.

By contrast, the pressing force of the tension spring 77 that moves the primary transfer roller 62 to contact the photoconductive drum 40 acts in the direction of rotation about the rotation fulcrum shaft 73 indicated by the arrow C. Because the direction of the contact force of the compression spring 76 contacting the rotary bias terminal 72 and the bias terminal 75 is perpendicular to the direction of the pressing force of the tension spring 77, the contact force does not affect the pressing force and the contact pressure of the primary transfer roller 62 against the photoconductive drum 40.

In this configuration, even when a tension force or the like acts on the harness cable of the main body connected to the bias terminal 75, causing the contact force of the compressing spring 76 to fluctuate, the pressing force of the tension spring 77 is not affected by the contact force. Accordingly, the primary transfer roller 62 contacts the photoconductive drum 40 reliably at a desired pressure.

With reference to FIGS. 5A and 5B, a more detailed description is provided of the roller support bracket 71, the bias application bracket 74, the rotation fulcrum shaft 73, and the compression spring 76.

As illustrated in FIG. 5A, the rotation fulcrum shaft 73 has a cylindrical shape in cross-section and includes a first cylinder portion 73*a* covered with a tubular portion 71*a* of the roller support bracket 71 and a second cylinder portion 73*b* at the tip of rotation fulcrum shaft 73 (on the right in FIG. 5A), having a notch portion in cross-section and projecting from the tubular portion 71*a*. The second cylinder portion 73*b* includes a groove 73*c* on the circumferential surface of the rotation fulcrum shaft 73. The groove 73*c* serves as an engaging portion and is different from the notch portion described above. The groove 73*c* is formed by cutting a portion of the circumferential surface of the rotation fulcrum shaft 73.

Furthermore, the rotation fulcrum shaft 73 includes a bracket contact portion 73*d* substantially at a basal portion of the rotation fulcrum shaft 73 (on the left in FIG. 5A) from the first cylinder portion 73*a*. The roller support bracket 71 contacts the bracket contact portion 73*d*.

The roller support bracket 71 is formed of insulating material and fixedly supports the rotary bias terminal 72. The roller support bracket 71 includes the tubular portion 71*a* that covers the surface of the first cylinder portion 73*a* of the rotation fulcrum shaft 73, and a terminal contact support 71*c* that supports the rotary terminal input contact 72*a* of the rotary bias terminal 72 in the axial direction. In other words, the tubular portion 71*a* is disposed between the rotation fulcrum shaft 73 and the compression spring 76. The tubular portion 71*a* covers the rotation fulcrum shaft 73 at a creepage distance D in the axial direction of the rotation fulcrum shaft 73. Accordingly, the desired creepage distance can be secured with a small space, and leak current is prevented.

The tubular portion 71*a* insulates between the compression spring 76 and the rotation fulcrum shaft 73. The rotary terminal input contact 72*a* connects electrically the compression spring 76 and the rotary bias terminal 72. The contact of the compression spring 76 and the rotary terminal input contact 72*a* serving as the contact of the rotary bias terminal 72 are not fixed.

The bias application bracket 74 is formed of an insulating material and has a cylindrical shape inside thereof. The bias application bracket 74 fixedly supports the bias terminal 75 for the main body side. The position of the bias application bracket 74 is fixed to the rotation fulcrum shaft 73. The roller support bracket 71 and the bias application bracket 74 are made of insulating material, thereby preventing leak current.

The bias terminal 75 is connected electrically to the wire harness, not illustrated, at the bias input portion 75*b* illustrated in FIG. 1. As illustrated in FIG. 5B, the bias terminal 75 is connected electrically to the compression spring 76 at the terminal output contact 75*a*.

Inside the bias application bracket 74 having the cylindrical shape, the bias application bracket 74 includes a first storing portion 74*e* and a second storing portion 74*f*. The first storing portion 74*e* has a substantially circular shape in cross section with an internal diameter greater than an external diameter of the tubular portion 71*a* of the roller support bracket 71. The second storing portion 74*f* has a circular shape in cross section with an internal diameter smaller than the external diameter of the tubular portion 71*a*. A portion of the second storing portion 74*f* is notched in cross section. The second storing portion 74*f* fits the second cylinder portion 73*b*. The second storing portion 74*f* includes a flexible portion 74*d* connected to the bias application bracket 74 through a flexible support portion 74*c*. The flexible portion 74*d* includes a projection 74*a* and a flexible tip portion 74*b*.

The rotary bias terminal 72 is electrically connected to the conductive shaft bearing 70 (shown in FIG. 1) and includes the rotary terminal input contact 72*a* having an annular shape with a diameter greater than that of the rotation fulcrum shaft 73. The rotary terminal input contact 72*a* is disposed to contact the compression spring 76. As illustrated in FIG. 5B, the bias application bracket 74 is electrically connected the compression spring 76 while the bias application bracket 74 is fixed to the rotation fulcrum shaft 73.

The bias terminal 75 is electrically connected to the power source 80 through the wire harness, not illustrated. The bias terminal 75 includes the annular-shaped terminal output contact 75*a* having a diameter greater than that of the rotation fulcrum shaft 73. The rotary terminal input contact 75*a* is disposed to contact the compression spring 76. As illustrated in FIG. 5B, the bias application bracket 74 is electrically connected the compression spring 76 while the position of the bias application bracket 74 is fixed to the rotation fulcrum shaft 73.

The terminal output contact 75*a* and the rotary terminal input contact 72*a* are annular-shaped and provided around the rotation fulcrum shaft 73. In this configuration, the terminal output contact 75*a* and the rotary terminal input contact 72*a* can contact the compression spring 76 in a small space around the rotation fulcrum shaft 73, thereby reducing the size of electric connection by the voltage application path from the bias terminal 75 to the rotary bias terminal 72.

The compression spring 76 serves as the conductive connector that is elastically compressive in the axial direction of the rotation fulcrum shaft 73. As described above, the compression spring 76 contacts the rotary bias terminal 72 and the bias terminal 75 at different positions in the axial direction, thereby connecting electrically between the rotary bias terminal 72 and the bias terminal 75. Accordingly, the compression spring 76 connects reliably the rotary bias terminal 72 and the bias terminal 75.

According to the illustrative embodiment, the diameter of the compression spring 76 is greater than that of the rotation fulcrum shaft 73. The point of contact (the rotary terminal input contact 72*a*) of the rotary bias terminal 72 contacting the compression spring 76 and the contact (the terminal output contact 75*a*) of the bias terminal 75 are annular-shaped having a diameter greater than that of the rotation fulcrum shaft 73. In this configuration, the small space around the rotation fulcrum shaft 73 allows the compression spring 76 to connect reliably the rotary bias terminal 72 and the bias terminal 75, thereby reducing the size.

Next, a description is provided of fixation of the position of the bias application bracket 74 relative to the rotation fulcrum shaft 73.

In the image forming apparatus 500, the groove 73*c*, the flexible support portion 74*c*, the flexible portion 74*d*, and the projection 74*a* serve as a position fixing mechanism to fix the position of the bias application bracket 74 to the rotation fulcrum shaft 73. The flexible portion 74*d* is flexible in a vertical direction in FIG. 5A while the flexible portion 74*d* is cantilevered by the flexible support portion 74*c*. The projection 74*a* is swingably movable up and down in accordance with changes in the shape of the flexible portion 74*d*.

When fixing the bias application bracket 74 to the rotation fulcrum shaft 73, that is, from the state illustrated in FIG. 5A to the state illustrated in FIG. 5B, the bias application bracket 74 and the bias terminal 75 are moved in the direction of the rotation fulcrum shaft 73 (to the left in FIGS. 5A and 5B which coincides with the direction of arrow E in FIG. 1). While moving, the leading end of the second cylinder portion 73*b* comes in contact with the projection 74*a*, thereby moving the projection down.

As the bias application bracket 74 and the bias terminal 75 are moved further, the tubular portion 71*a* and the first cylinder portion 73*a* are fitted into the first storing portion 74*e*, and the second cylinder portion 73*b* is fitted into the second storing portion 74*f*. Accordingly, as illustrated in FIG. 5B, the projection 74*a* engages the groove 73*c*, thereby fixing the position of the bias application bracket 74 relative to the rotation fulcrum shaft 73 in the axial direction thereof.

The second cylinder portion 73*b* and the second storing portion 74*f* have a circular shape, a portion of which is notched in cross section. The notched portions of the second cylinder portion 73*b* and the second storing portion 74*f* engage together, thereby fixing the position of the bias application bracket 74 in the direction of rotation of the rotation fulcrum shaft 73. In this configuration, the position of the bias application bracket 74 is fixed in the axial direction as well as the direction of rotation of the rotation fulcrum shaft 73.

In the state illustrated in FIG. 5B, the pressure of the compression spring 76 compressed by a predetermined amount acts on the rotary terminal input contact 72*a* of the rotary bias terminal 72 and the terminal output contact 75*a* of the bias terminal 75 in the axial direction.

The position of the bias application bracket 74 supporting the bias terminal 75 is fixed relative to the rotation fulcrum shaft 73. The rotary bias terminal 72 receives the force in the axial direction from the bias terminal 75 through the compression spring 76. With this configuration, the position of the rotary bias terminal 72 and the roller support bracket 71 supporting the rotary bias terminal 72 in the axial direction of the rotation fulcrum shaft 73 is fixed. Such a position fixing mechanism can fix the position of the bias application bracket 74 and the roller support bracket 71 in the axial direction with a simple configuration, thereby reducing the number of parts and sizes, and hence reducing its cost and facilitating assembly.

More specifically, the position of the bias application bracket 74 and the roller support bracket 71 in the axial direction is easily fixed by engaging the projection 74*a* of the bias application bracket 74 and the groove 73*c* of the rotation fulcrum shaft 73. The projection 74*a* can engage the groove 73*c* by simply moving the bias application bracket 74, thereby facilitating assembly.

A description is provided of disengagement of the bias application bracket 74 and the rotation fulcrum shaft 73.

In order to disengage the bias application bracket 74 and the rotation fulcrum shaft 73, the flexible tip portion 74*b* serving as a disengaging member is moved down in FIG. 5A, moving the projection 74*a* down. Accordingly, the projection 74*a* is disengaged from the groove 73*c*.

By moving the bias application bracket 74 and the bias terminal 75 in the direction away from the rotation fulcrum shaft 73 (to the right in FIG. 5A(5B)) while the projection 74*a* is disengaged from the groove 73*c*, the tubular portion 71*a*, the first cylinder portion 73*a*, and the second cylinder portion 73*b* are separated from the first storing portion 74*e* and the second storing portion 74*f*. Accordingly, the bias application bracket 74 is removed from the rotation fulcrum shaft 73.

According to the present embodiment, separation of the bracket 74 from the groove 73 only requires moving the projection 74*a*, thereby facilitating assembly.

According to the illustrative embodiment, each of the primary transfer rollers is supported by the roller support member (the roller support bracket) so that the size of the roller support member is small, enhancing the strength, when compared with the swingable arm extending horizontally along the photoconductive drums as in the related-art image forming apparatus.

According to the illustrative embodiment, each of the primary transfer rollers is supported by the roller support member pressed by the spring. The roller support member is urged by the spring so that the primary transfer roller presses against the photoconductive drum. This allows the length of the spring to be long. This configuration is advantageous in that a spring constant of the spring can be small, thereby reducing variations in the contact pressure of the primary transfer roller.

According to the illustrative embodiment, the primary transfer roller 62 of the image forming apparatus 500 can be applied with a bias with a simple configuration, and the electric connection for application of the bias does not adversely affect the contact pressure of the primary transfer roller 62.

As described above, the primary transfer area of the image forming apparatus 500 includes the roller support bracket 71 to support rotatably the primary transfer roller 62, and the rotary bias terminal 72 provided to the roller support bracket 71 and connected electrically to the primary transfer roller 62.

Furthermore, the primary transfer area includes the bias application bracket 74 and the rotation fulcrum shaft 73 to support rotatably the roller support bracket 71. The bias terminal 75 that applies voltage to the primary transfer roller 62 through the rotary bias terminal 72 is fixed to the bias application bracket 74. The bias application bracket 74 is fixed to the rotation fulcrum shaft 73.

The power source 80 that applies the high-voltage primary transfer voltage to the primary transfer roller 62 is connected to the bias terminal 75 through the wire harness, not illustrated. Further, the bias terminal 75 and the rotary bias terminal 72 are connected electrically by the compression spring 76. In the coil-shaped compression spring 76, the rotation fulcrum shaft 73 is disposed. The wire harness is connected to the bias terminal 75 provided to the bias application bracket 74 fixed to the rotation fulcrum shaft 73. Therefore, connection of the wire harness does not affect the operation of the roller support bracket 71. For example, even when a certain tension acts on the wire harness connected to the bias terminal 75, the tension of the wire harness does not act on the roller support bracket 71.

In the primary transfer area of the image forming apparatus 500, the contact force of the compression spring 76 acts substantially near the rotation fulcrum shaft 73 which is the center of rotation of the roller support bracket 71. Therefore, the effect of the contact force of the compression spring 76 on the contact pressure of the primary transfer roller 62 can be minimized.

Furthermore, even when the tension of the wire harness which is difficult to control is generated, the tension of the wire harness does not act on the roller support bracket 71 supporting the primary transfer roller 62. Accordingly, the primary transfer roller 62 can contact reliably the photoconductive drum 40 at a stable pressure.

The device that electrically connects the rotary bias terminal 72 and the bias terminal 75 is not limited to the compression spring 76 as described above. Such a device may include, but is not limited to, for example, a conductive sponge, a conductive rubber, and a leaf spring such as a corrugated washer.

The roller support bracket 71 and the bias application bracket 74 are formed of insulating material. As illustrated in FIG. 5B, the roller support bracket 71 covers the rotation fulcrum shaft 73 at the creepage distance D indicated by the arrow D. Since the tubular portion 71*a* is stored in the first storage portion 74*e* and the rotary terminal input contact 72*a* is stored in the space inside the roller support bracket 71, for example, the tubular portion 71*a*, the desired creepage distance is reliably secured, even when the housing of the intermediate transfer device employs mostly metal plates. With this configuration, leak current can be prevented by using only two parts, that is, the roller support bracket 71 and the bias application bracket 74.

According to the illustrative embodiment, the bias application bracket 74 and the rotation fulcrum shaft 73 are fixed in the axial direction by the projection (claw) 74*a* of the bias application bracket 74. The roller support bracket 71 is fixed in the axial direction by contacting the bias application bracket 74. With this configuration, upon assembly of the primary transfer area of the image forming apparatus 500, the rotation fulcrum shaft 73 is inserted into the roller support bracket 71, and then pushed into the bias application bracket 74. An advantage of this configuration is that a retaining ring or the like is not needed, thereby reducing the number of parts and its cost, and facilitating assembly.

The foregoing description pertains to application of voltage to the primary transfer roller 62 that moves to contact the photoconductive drum 40. That is, the position of the primary transfer roller 62 changes relative to the main body. The present invention can be applied to the secondary transfer roller 23 applied with a voltage, that contacts or separates from the intermediate transfer belt 10 opposite the secondary transfer support roller 16.

[Variation 1]

Referring back to FIG. 1, a description is provided of another illustrative embodiment of the present invention. According to the present embodiment, the secondary transfer roller 23 is applied with voltage using the same or similar configuration as that of the foregoing embodiment. The only difference between the foregoing embodiment and the present embodiment is the application of voltage to the secondary transfer roller 23. Thus, the description of the image forming apparatus 500 is omitted.

According to the present embodiment, the image forming apparatus 500 includes the intermediate transfer belt 10 bearing the toner image, the secondary transfer device 19 disposed opposite the intermediate transfer belt 10. The secondary transfer device 19 secondarily transfers the toner image from the intermediate transfer belt 10 onto the recording medium using the secondary transfer electric field.

The secondary transfer device 19 includes the secondary transfer roller 23 and the secondary transfer roller support member, not illustrated. The secondary transfer roller 23 applied with the secondary transfer voltage contacts the intermediate transfer belt 10. The secondary transfer roller support member rotatably supports the secondary transfer roller 23 and rotates about a rotation fulcrum shaft fixed to the main body.

Similar to the foregoing embodiment, the secondary transfer device 19 includes an biasing member and a rotary conductive member. The biasing member urges the secondary transfer roller support member such that the secondary transfer roller 23 rotatably moves in a pressing direction relative to the intermediate transfer belt 10.

The image forming apparatus 500 includes a secondary transfer voltage application device to apply the secondary transfer voltage to the secondary transfer roller 23 via the rotary conductive member. The secondary transfer voltage application device is fixed to the main body of the image forming apparatus 500.

According to the present embodiment, the secondary transfer device 19 includes a conductive member for the main body and a conductive connector that connects electrically the conductive member for the main body and the rotary conductive member. The conductive member for the main body is fixed to the rotation fulcrum shaft and connected electrically to the voltage application device. The conductive connector is disposed along the rotation fulcrum shaft and connected electrically to the rotary conductive member by contacting the rotary conductive member in the axial direction of the rotation fulcrum shaft. The contact of the conductive connector and the contact of the rotary conductive member are not fixed.

According to the present embodiment, the configuration of the voltage application path from the secondary transfer voltage application device to the secondary transfer roller 23 does not affect the contact pressure of the secondary transfer roller 23 relative to the intermediate transfer belt 10. Accordingly, the secondary transfer roller 23 contacts reliably the intermediate transfer belt 10 (the secondary transfer support roller 16) at a stable pressure.

The foregoing description pertains to the image forming apparatus in which the toner image formed on the photoconductive drum 40 is primarily transferred onto the intermediate transfer belt 10, and then the toner image is secondarily transferred from the intermediate transfer belt 10 to the recording medium. However, the present invention is not limited to the image forming apparatus using the intermediate transfer member such as the intermediate transfer belt 10. The present invention can be applied to an image forming apparatus using a direct transfer method in which the toner image formed on the photoconductive drum is transferred directly onto the recording medium.

[Variation 2]

Figure 6:
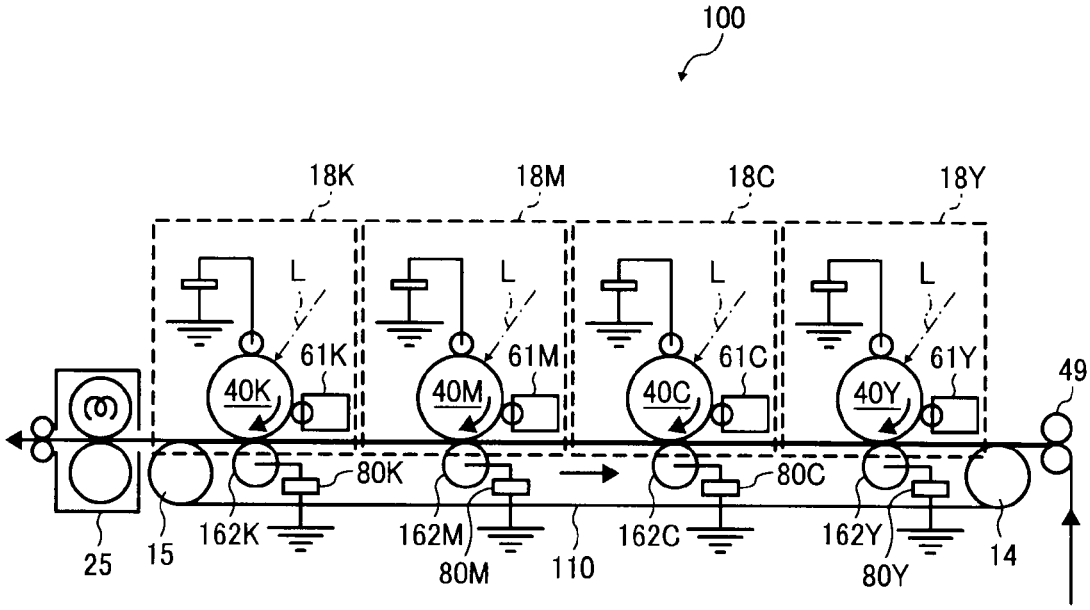
FIG. 6 is a schematic diagram illustrating a printer unit of the image forming apparatus according to another illustrative embodiment of the present invention.

With reference to FIG. 6, a description is provided of still another illustrative embodiment of the present invention. FIG. 6 is a schematic diagram illustrating the printer unit 100 of the image forming apparatus 500 according to still another illustrative embodiment of the present invention.

As illustrated in FIG. 6, in the printer unit 100, the recording medium passing through the pair of registration rollers 49 is conveyed to the left in FIG. 6 by a transfer conveyance belt 110. The toner images on the photoconductive drums 40 are directly transferred onto the recording medium at the position opposite the photoconductive drums 40.

The toner images are transferred onto the recording medium so that they are superimposed one atop the other, thereby forming a composite color toner image. The recording medium bearing the composite color image is conveyed to the fixing device 25 by the transfer conveyance belt 110 that moves endlessly, thereby fixing the color image on the recording medium.

It is to be noted that the present embodiment may employ the same or similar transfer voltage application mechanism that applies the transfer voltage to the primary transfer roller 62 of the foregoing embodiment. In other words, transfer rollers 162 (Y, C, M, and K) contacting the photoconductive drums 40 (Y, C, M, and K) through the transfer conveyance belt 110 are applied with the transfer voltage using the same or similar transfer voltage application mechanism of the foregoing embodiment.

According to the present embodiment, each of the transfer portions of the printer unit 100 includes the photoconductive drum 40 to bear the toner image, the transfer conveyance belt 110 wound around the plurality of support rollers, and the transfer roller 162 disposed inside the belt loop formed by the transfer conveyance belt 110. The transfer roller 162 is applied with the transfer voltage and contacts the photoconductive drum 40 through the transfer conveyance belt 110.

Furthermore, although not illustrated, the transfer portion includes a transfer roller support member rotatable about the rotation fulcrum shaft fixed to the main body, to serve as a rotary member that rotatably supports the transfer roller 162.

The transfer portion includes an biasing member and a rotary conductive member. The biasing member urges the transfer roller support member such that the transfer roller 162 rotatably moves in the pressing direction relative to the photoconductive drum 40. The rotary conductive member is fixed to the transfer roller support member and electrically connected to the transfer roller 162.

The printer unit 100 of the present embodiment includes the power source 80 serving as the transfer voltage application device to apply the transfer voltage to the transfer roller 162 via the rotary conductive member. The power source 80 is fixed to the main body.

According to the present embodiment, similar to the foregoing embodiments, the transfer portion of the printer unit 100 includes a conductive member for the main body and a conductive connector that connects electrically the conductive member for the main body and the rotary conductive member. The conductive connector is disposed along the rotation fulcrum shaft and connected electrically to the rotary conductive member by contacting the rotary conductive member in the axial direction of the rotation fulcrum shaft. The contact of the conductive connector and the contact of the rotary conductive member are not fixed.

According to the present embodiment, the voltage application path from the power source 80 to the transfer roller 162 does not affect the contact pressure of the transfer roller 162 relative to the photoconductive drum 40. Accordingly, the transfer roller 162 contacts reliably the photoconductive drum 40 at a desired pressure.

According to the foregoing embodiments, the present invention is applied to a transfer portion of a tandem-type image forming apparatus. However, the present invention is not limited to the tandem-type image forming apparatus. The present invention may be applied to a transfer portion of an image forming apparatus including a single drum and a monochrome image forming apparatus.

According to the foregoing embodiments, the present invention is applied to a transfer portion of the image forming apparatus in which a contact member is a transfer member (for example, the primary transfer roller 62, the secondary transfer roller 23, and the transfer roller 162). However, the present invention is not limited to the contact member provided to the transfer portion.

The present invention may be applied to a configuration in which a contact member such as a developer charge application roller applied with voltage contacts an object such as a developing sleeve.

The contact member applied with the voltage is not limited to one connected to a power source. The contact member may be one connected to ground.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. An image forming apparatus, comprising:

a contact member supplied with a voltage, to contact an object;

a rotary member rotatable about a rotation fulcrum shaft fixed to the image forming apparatus, to support the contact member;

a biasing member to urge the rotary member to press the contact member against the object;

a rotary conductive member fixed to the rotary member and connected electrically to the contact member;

a voltage application device fixed to the image forming apparatus, to apply voltage to the contact member through the rotary conductive member;

a main body side conductive member fixed to the rotation fulcrum shaft at the main body side and connected electrically to the voltage application device; and a conductive connector provided along the rotation fulcrum shaft to contact the rotary conductive member in the axial direction of the rotation fulcrum shaft to connect electrically the main body side conductive member and the rotary conductive member, a contact of the conductive connector and a contact of the rotary conductive member being unfixed.

2. The image forming apparatus according to claim 1, wherein the conductive connector is elastically compressible in the axial direction of the rotation fulcrum shaft.

3. The image forming apparatus according to claim 2, wherein the conductive connector is a compression spring having a diameter greater than that of the rotation fulcrum shaft, and the contact of the rotary conductive member contacting the conductive connector and the contact of the main body side conductive member contacting the conductive connector have an annular shape with a diameter greater than that of the rotation fulcrum shaft.

4. The image forming apparatus according to claim 1, further comprising a conductive member support fixed to the rotation fulcrum shaft, to support the main body side conductive member, wherein the rotary member and the conductive member support are made of insulating material.

5. The image forming apparatus according to claim 4, wherein the rotary member includes a cover portion between the rotation fulcrum shaft and the conductive connector, to cover the rotation fulcrum shaft for a predetermined distance in the axial direction of the rotation fulcrum shaft.

6. The image forming apparatus according to claim 4, further comprising a position fixing mechanism to fix the position of the conductive member support relative to the rotation fulcrum shaft, wherein when the position fixing mechanism fixes the position of the conductive member support, the conductive connector is pressed against the rotary member to fix the position of the rotary member in the axial direction.

7. The image forming apparatus according to claim 6, wherein the position fixing mechanism includes a projection provided to the conductive member support and a groove provided to the rotation fulcrum shaft, and the projection engages the groove.

8. The image forming apparatus according to claim 7, wherein the conductive member support includes a disengaging member that disengages the projection from the groove and removes the conductive member support from the rotation fulcrum shaft.

9. The image forming apparatus according to claim 1, wherein the object that the contact member contacts is an image bearing member that bears a toner image, and the contact member disposed opposite the image bearing member is a transfer member to contact the image bearing member through one of an intermediate transfer member and a recording medium and form a transfer electric field between the image bearing member and the transfer member when a transfer voltage is applied thereto.

10. The image forming apparatus according to claim 9, further comprising a secondary transfer member, wherein the intermediate transfer member is a belt member wound around a plurality of rollers and formed into a loop, the transfer member is disposed inside the loop formed by the intermediate transfer member, the transfer electric field formed between the transfer member and the image bearing member causes the toner image on the image bearing member to transfer onto the intermediate transfer member, and the secondary transfer member transfers the toner image on the intermediate transfer belt onto the recording medium.

* * * * *